US011706554B2

(12) United States Patent
Freire et al.

(10) Patent No.: US 11,706,554 B2
(45) Date of Patent: Jul. 18, 2023

(54) EARPHONE WITH AN ACOUSTIC REAR CHAMBER VENT

(71) Applicant: GN AUDIO A/S, Ballerup (DK)

(72) Inventors: Nuno Beleza Freire, Ballerup (DK); Jacob Reimert, Ballerup (DK)

(73) Assignee: GN AUDIO A/S, Ballerup (DK)

( * ) Notice: Subject to any disclaimer, the term of this patent is extended or adjusted under 35 U.S.C. 154(b) by 0 days.

(21) Appl. No.: 17/757,172

(22) PCT Filed: Dec. 15, 2020

(86) PCT No.: PCT/EP2020/086090
§ 371 (c)(1),
(2) Date: Jun. 10, 2022

(87) PCT Pub. No.: WO2021/130049
PCT Pub. Date: Jul. 1, 2021

(65) Prior Publication Data

US 2023/0022343 A1 Jan. 26, 2023

(30) Foreign Application Priority Data

Dec. 27, 2019 (DK) ..... PA 2019 01554

(51) Int. Cl.
*H04R 25/00* (2006.01)
*H04R 1/10* (2006.01)

(52) U.S. Cl.
CPC ..... *H04R 1/1008* (2013.01); *H04R 1/1058* (2013.01); *H04R 2201/107* (2013.01); *H04R 2460/11* (2013.01)

(58) Field of Classification Search
CPC .. H04R 1/1091; H04R 1/1016; H04R 1/2811; H04R 1/2819; H04R 1/2826; H04R 1/2857; H04R 2201/10
See application file for complete search history.

(56) References Cited

U.S. PATENT DOCUMENTS 6,831,984 B2 12/2004 Sapiejewski
2014/0072161 A1 3/2014 Boyle et al.
(Continued)

FOREIGN PATENT DOCUMENTS

CN 104244130 A 12/2014
CN 104301838 A 1/2015
(Continued)

OTHER PUBLICATIONS

International Search Report and Written Opinion issued PCT/EP2020/086090, dated Mar. 30, 2021, 11 pages provided.
(Continued)

*Primary Examiner* — Amir H Etesam
(74) *Attorney, Agent, or Firm* — Hamre, Schumann, Mueller & Larson, P.C.

(57) ABSTRACT

An earphone comprising a rear chamber and a vent structure. The vent structure comprises
- a longitudinal recess in the housing wall, which recess is defined by a bottom wall and recess walls connecting the bottom wall and the housing wall,
- a recess opening in the recess, which recess opening connects the recess and the rear chamber,
- a mesh device arranged parallel with the bottom wall, whereby a longitudinal recess cavity is provided between the bottom wall and the mesh structure.

The invention also relates to the manufacturing such an earphone.

10 Claims, 8 Drawing Sheets

(56) References Cited

U.S. PATENT DOCUMENTS

| | | | | |
|---|---|---|---|---|
| 2015/0382100 | A1* | 12/2015 | Azmi | H04R 1/1091 381/380 |
| 2016/0219360 | A1 | 7/2016 | Zhao et al. | |
| 2017/0195776 | A1 | 7/2017 | Reimert | |
| 2018/0352318 | A1 | 12/2018 | Yoneyama et al. | |

FOREIGN PATENT DOCUMENTS

| | | | |
|---|---|---|---|
| CN | 206698398 | U | 12/2017 |
| GB | 2536208 | A | 9/2016 |

OTHER PUBLICATIONS

Office Action issued in corresponding Danish Application No. PA 2019 01554, dated Jun. 2, 2020, 7 pages provided.
Search Report issued in corresponding Danish Application No. PA 201901554, dated Jun. 2, 2020, 4 pages provided.

* cited by examiner

EARPHONE WITH AN ACOUSTIC REAR CHAMBER VENT

TECHNICAL FIELD

The present invention relates to an earphone configured to provide an acoustic output to an ear of a wearer and further configured to be arranged on the wearer's head in an operating position such that a front chamber between the head and the earphone is separated from ambient space, the earphone comprising:

a housing having a housing wall separating a rear chamber from ambient space, the housing wall including a dividing wall separating the rear chamber from the front chamber, a diaphragm suspended across an opening in the dividing wall and configured to be actively driven to provide the acoustic output, a vent structure fluidly connecting the rear chamber and ambient space through the housing wall.

BACKGROUND ART

In the art, various earphones are known, which employ passive noise reduction (PNR) to reduce the amount of acoustic noise reaching the wearer's ears. PNR is typically achieved by acoustic dampening in structural components, such as earphone shells and ear cushions. It is further known to combine PNR with active noise cancelling (ANC) that actively counteracts acoustic noise approaching the wearer's ears, thereby attempting to cancel out and thus remove the noise from the sound reaching the ears. ANC is typically achieved by controlling the output of a driver in the earphone such that it counteracts the residual noise that escapes the PNR.

PNR is generally effective at frequencies above about 1 kHz, while the effect decreases towards lower frequencies and is practically non-existing at frequencies below about 100 Hz. Conversely, ANC is generally effective in the frequency range below about 1 kHz, while it is difficult to achieve good results for higher frequencies. Noise reduction using a combination of PNR and ANC can thus in principle be made effective within the entire audio frequency range.

For some earphones passive attenuation of ambient noise is desired while at the same time obtaining a proper low frequency audio reproduction.

Typically, earphones providing passive noise reduction and audio are two-chamber earphones, having a front cavity and a rear cavity, and comprising a speaker, i.e. an actively driven diaphragm suspended in a wall between the two cavities.

To obtain a good reproduction of low frequency audio, flow restrictions on the side of the diaphragm facing away from the ear should be avoided or limited. This may for example be obtained by having a rear cavity which is sufficiently large or by having an opening in rear cavity.

On the other hand, to provide good passive noise attenuation the rear cavity should be closed and relatively small which however restricts flow on the side of the diaphragm facing away from the ear.

There is thus a trade-off between passive noise attenuation and good audio reproduction at low frequencies.

It has been suggested to solve this trade-off by providing a so-called vent in the rear cavity, i.e. a hole in the rear cavity covered with an acoustic resistive material. By providing a low vent resistance, a fair low frequency reproduction may be obtained, while a high vent resistance provides for a higher passive attenuation, but a poorer low frequency reproduction.

U.S. Pat. No. 6,831,984 B2 discloses an earphone comprising a rear chamber which is connected to the ambient space by a port and a resistive opening in parallel with the port. The acoustic mass of the port and the compliance of the rear chamber are tuned to a resonance frequency of about 300 Hz. This causes the rear chamber to be acoustically closed above 300 Hz and acoustically open below 300 Hz.

US 2017/0195776 A1 discloses an earphone where the rear chamber is connected to the ambient space by a port structure with a port wall comprising acoustically permeable sections. Explanation of how acoustic tuning of earphones are provided by openings, tubes and resistive meshes are explained in detail in US 2017/019577, which is incorporated herein by reference.

It can be problematic to fit the vent and port structures of the prior art into earphones of restricted size, inter alia because the ports often need to be of a certain length. As these earphone housing often a manufactured by injection moulding, the port and venting structures needs complex molds with movable core parts and cost increasing tooling and/or assembling steps after the injection molding process.

The object of the invention is to provide a new and improved earphone and a method of manufacturing such an earphone.

DISCLOSURE OF INVENTION

The earphone according to the invention is characterizing in that the vent structure comprises

- a longitudinal recess in the housing wall, which recess is defined by a bottom wall and recess walls connecting the bottom wall and the housing wall,
- a recess opening in the recess, which recess opening connects the recess and the rear chamber,
- a mesh device arranged parallel with the bottom wall, whereby a longitudinal recess cavity is provided between the bottom wall and the mesh structure.

This is a simple and compact structure, that is easy and cheap to manufacture and fit into a compact earphone construction.

According to an embodiment, an ear cushion is arranged and configured to attenuate acoustic signals entering the front chamber from ambient space, when the earphone is in the operating position.

According to an embodiment, the recess cavity has a length of 5-30 mm.

According to an embodiment, the recess cavity has a width of 1-10 mm.

According to an embodiment, the recess cavity has a depth of 1-10 mm.

According to an embodiment, the recess cavity has a cross-section of 2-20 $mm^2$.

According to an embodiment, the recess is curved.

According to an embodiment, the recess cavity is tuned to provide a resonance frequency in one of the ranges: 50-1000 Hz, 100-500 Hz, 150-400 HZ, 200-300 Hz.

According to an embodiment, the earphone comprises a unitary earphone element comprising an end wall and a circumferential side wall, and wherein the recess is provided in the end wall, and wherein the earphone element is shaped, such it can be manufactured in an injection mould without overhangs.

The invention also relates to a method of manufacturing an earphone, wherein the earphone element is manufactured in an injection molding process, where after the mesh device is attached to the earphone element.

According to an embodiment, the dividing wall is attached to the circumferential side wall after the injection molding of the earphone element The invention can be utilised with circumaural earphones, which encompass the ears, and supra-aural earphones, which press against the ears and in-ear earphones.

BRIEF DESCRIPTION OF THE DRAWINGS

The invention is explained in detail below with reference to the schematic drawing illustrating preferred embodiments of the invention and in which.

MODES FOR CARRYING OUT THE INVENTION

Figure 1:
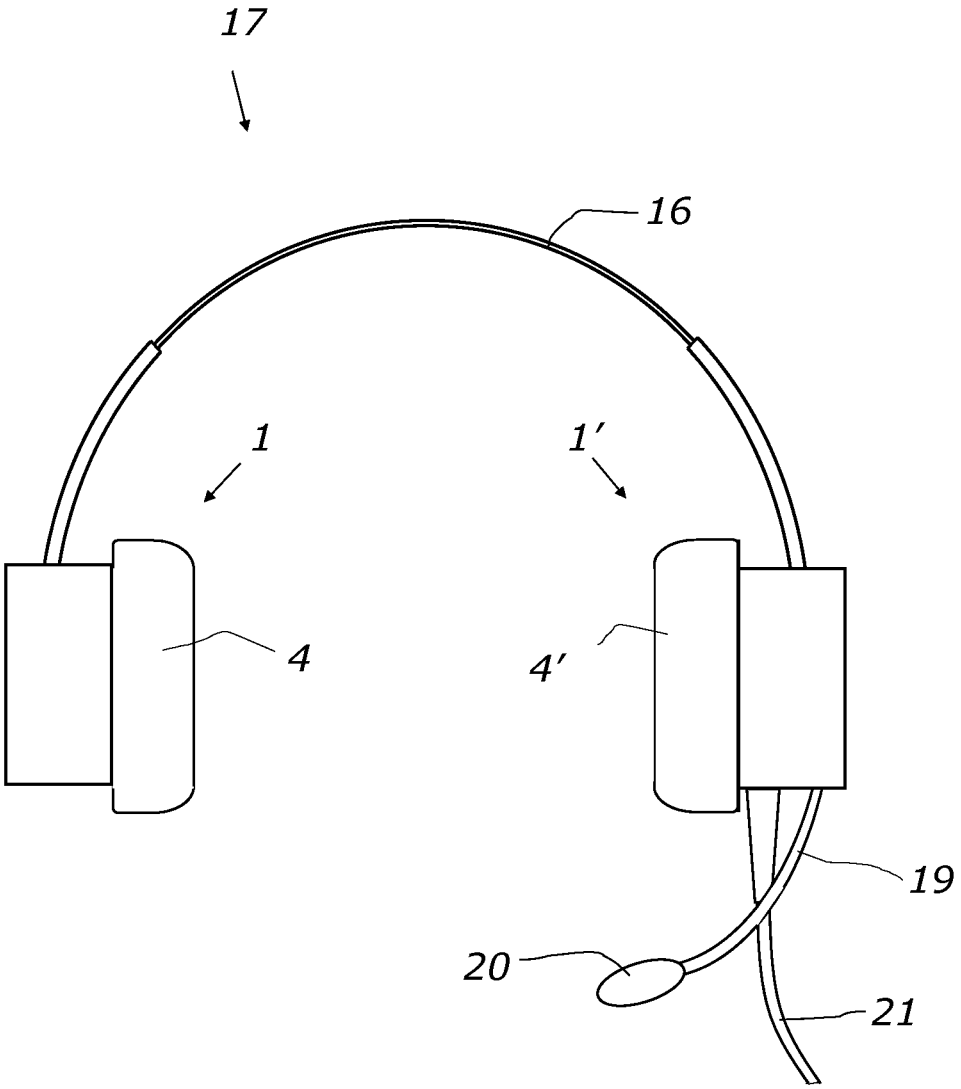
FIG. 1 is a front view of a headset comprising an earphone according to the invention, FIG. 2 a cross-sectional view through an earphone according to a first embodiment of the invention.

FIG. 1 is a front view of a headset 17 comprising a headband 16, an earphone 1 and a second earphone 1', a microphone arm 19 with a microphone 20 and a cable 21 connecting the headset with a not-shown telecommunication device such as a smart phone or laptop. Each of the earphones 1, 1' comprises an ear cushion 4. The invention relates to the earphone 1 and will described further in the following.

Figure 2:
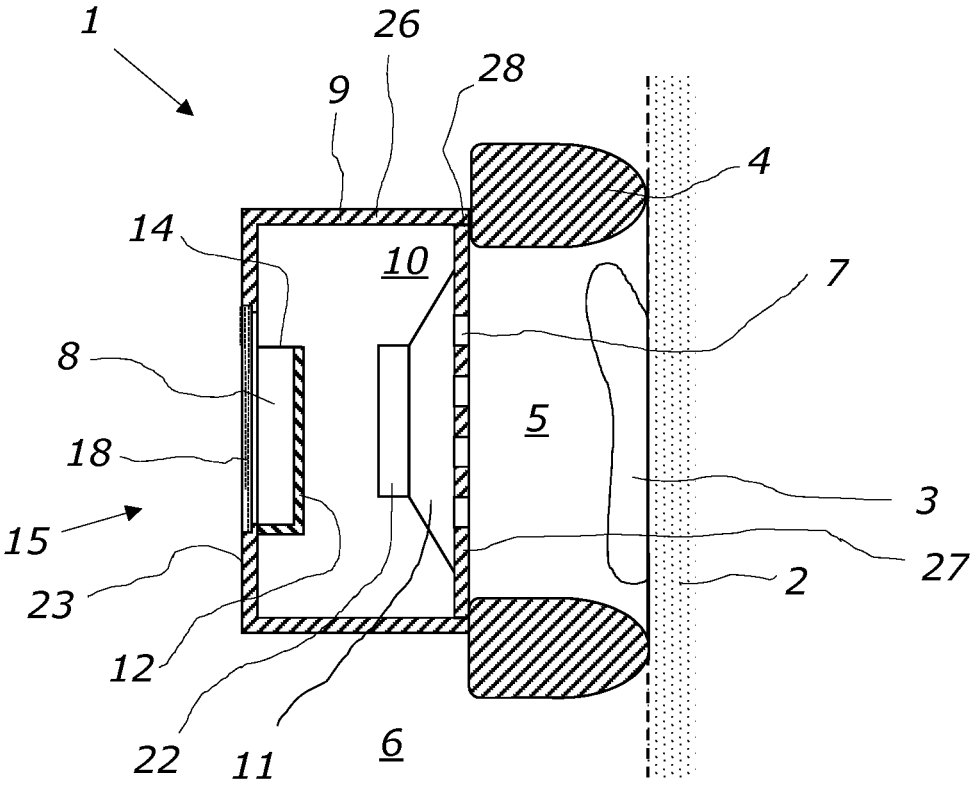

FIG. 2 a schematic cross-sectional view through the earphone 1 according to a first embodiment of the invention. The headband 16 other parts, which are not relevant for the invention, are left out. The figure shows the earphone 1 in a state of use, where the ear cushion 4 encompasses a user's ear 4 and engages the head 2 of the user. The earphone 1 comprises a housing wall 9, which includes an end wall 23, an opposite dividing wall 27 and a side wall 26 connecting the end wall 23 and the dividing wall 27. A speaker 22 with a diaphragm 11 is arranged inside the earphone housing 9 close to the dividing wall 27. Sound holes 7 are provided in the dividing wall 27 to let audio from the speaker 22 pass to a front chamber 5, which is encompassed by the dividing wall 27, the ear cushion 4 and the user's head 2. The housing wall 9 is made up by an earphone element 29 and the dividing wall 27. The earphone element 29, which comprises the end wall 23 and the side wall 26, is a molded plastic part which is welded together with the dividing wall 27 with a welding seam 28. In the end wall 23 a vent structure 15 is provided, which will be explained further in the following.

Figure 3:
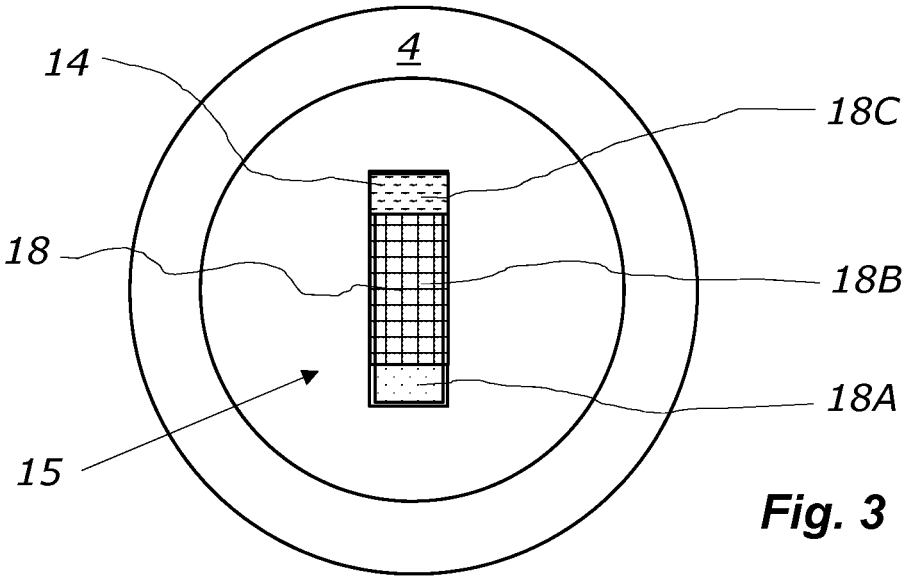
FIG. 3 is an end view of the earphone according to the first embodiment.

FIG. 3 is an end view of the earphone 1 according to the first embodiment. The end wall 23 comprises the vent structure 15, which includes a recess opening 14 and a mesh device 18. The mesh device comprises three layered mesh parts 18A, 18B and 18C.

Figure 4:
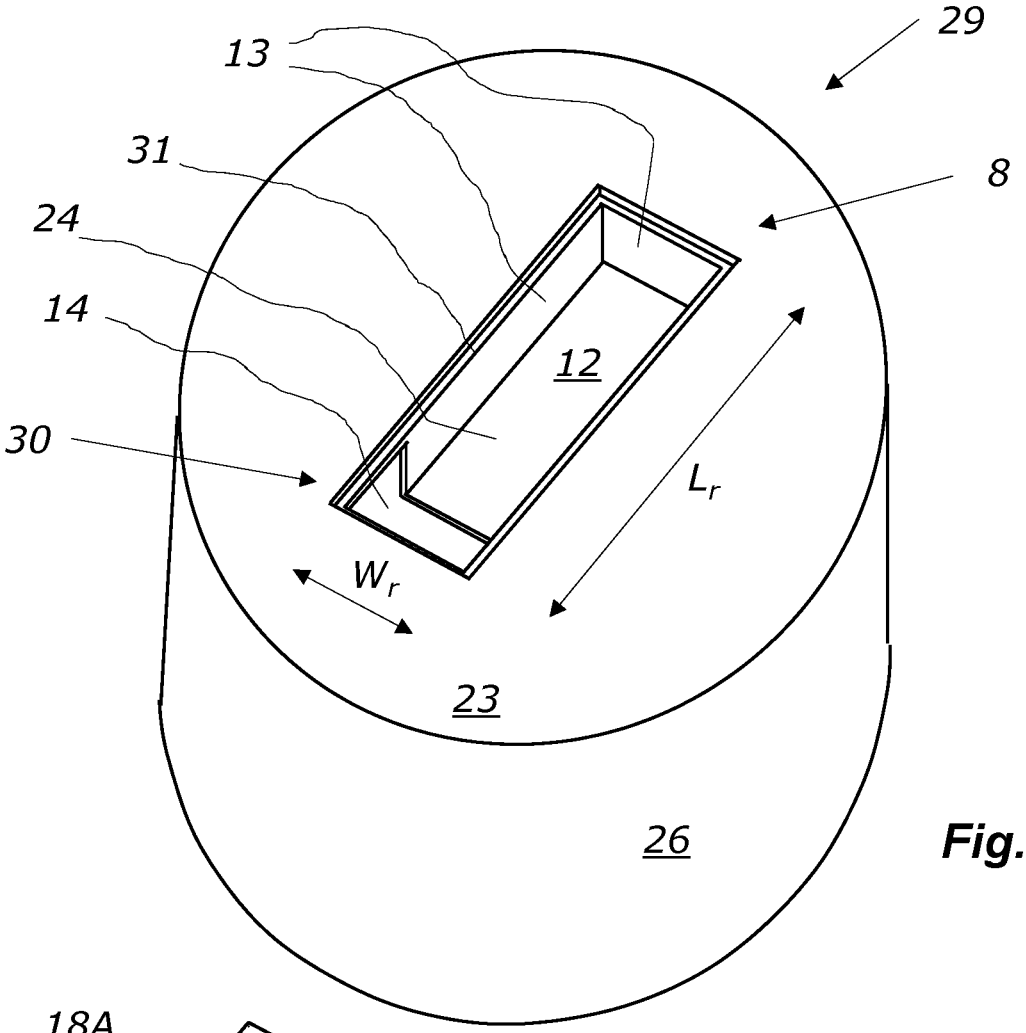
FIG. 4 is a perspective view of an earphone element for manufacturing and earphone according to the invention, FIG. 5 three different mesh parts for manufacturing a mesh device for an earphone according to the invention.

FIG. 4 is a perspective view of the earphone element 29 for manufacturing and earphone 1 according to the invention. The earphone element 29 is somewhat cup shaped comprising the end wall ("cup bottom") 23 and side wall 26. In the end wall 23 a recess 8 is provided. The recess 8 is defined by a bottom wall 12 and recess walls 13 connecting the bottom wall 12 and the end wall 23. A recess cavity 24 provided by the recess 8 is oblong with a length $L_r$ that is larger than the a $W_r$. At a first end 30 of the recess 8 there is a recess opening 14 providing a fluid connection between the rear chamber and the ambient space 6. The side wall 26 extends all the way around the end wall 23. The end opposite the end wall 23 is open. The side wall 26 and the recess walls 13 are designed with no "overhangs" and slightly angled, so that the earphone element 29 can be injection molded and ejected from a relatively simple and inexpensive mold. No slides, that move into the molding cavity perpendicular to the draw direction, to form overhanging part features is needed. At the periphery of the recess 8, a shoulder 31 is provided for attachment of the mesh device 18, which will be explained in the following.

Figure 5A:
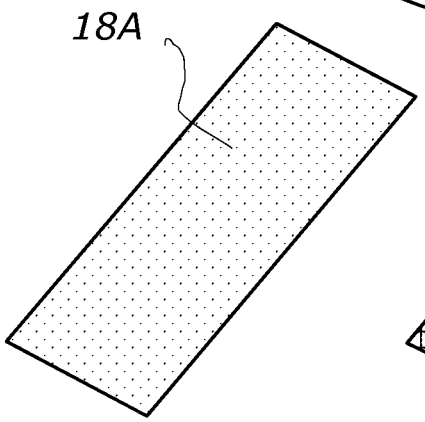
Figure 5B:
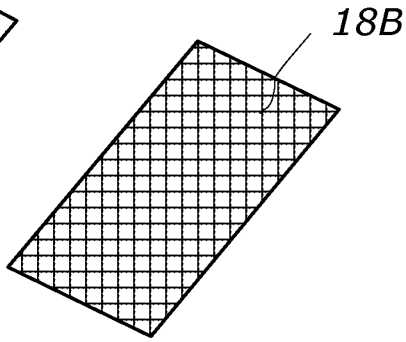
Figure 5C:
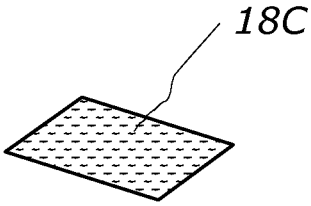

FIG. 5 discloses three different mesh parts 18A, 18B, 18C for manufacturing a mesh device 18 for an earphone 1 according to the invention. The mesh parts 18A, 18B, 18C can have different lengths and acoustic permeability and be combined in different ways to provide the desired acoustic characteristics of the vent structure 15. Here is shown a first mesh part 18A, a second mesh part 18B and a third mesh part 18C. In the first embodiment shown in FIG. 3 the mesh structure 18 comprises all three mesh parts 18A, 18B, 18C.

Figure 6:
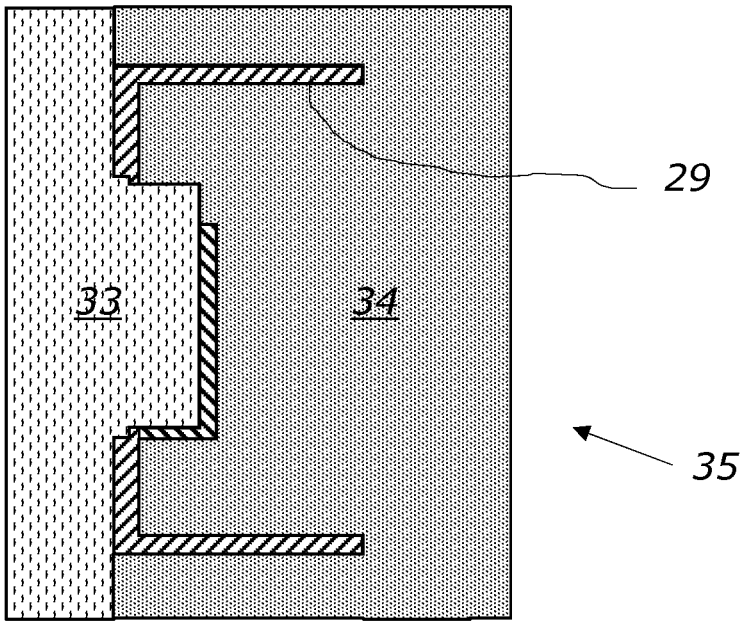
FIG. 6 is a cross-sectional view through an injection mold for manufacturing an earphone element, FIG. 7 a cross-sectional view through the injection mold in open position.

FIG. 6 is a schematic cross-sectional view through an injection mold 35 for manufacturing the earphone element 29. The injection mold 35 comprises a core part 33 and a cavity part 34. In FIG. 6 the mold is in a closed position, and the mold cavity is filled with plastics to form the earphone element 29.

Figure 7:
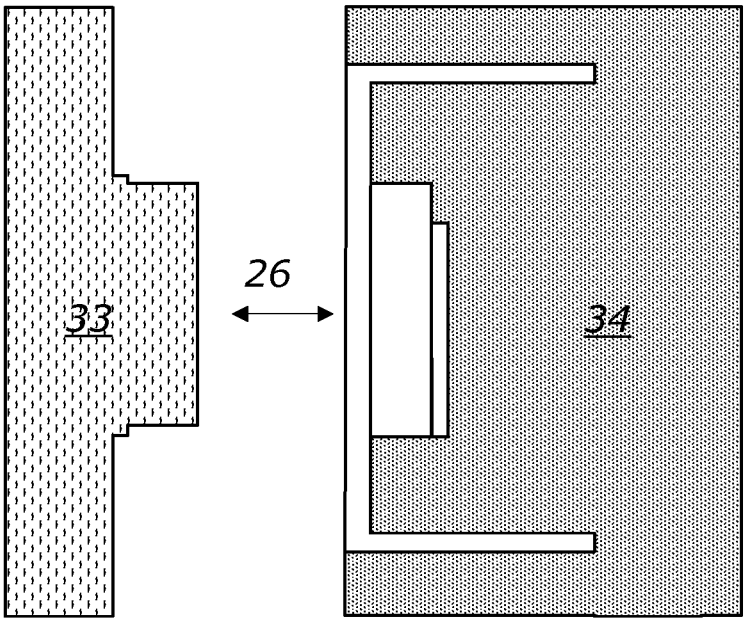

FIG. 7 is a schematic cross-sectional view through the injection mold 25 in open position, where the core part 33 and the cavity part 34 are moved away from each other in the draw direction 36. The finished earphone element 29 is removed.

Figure 8:
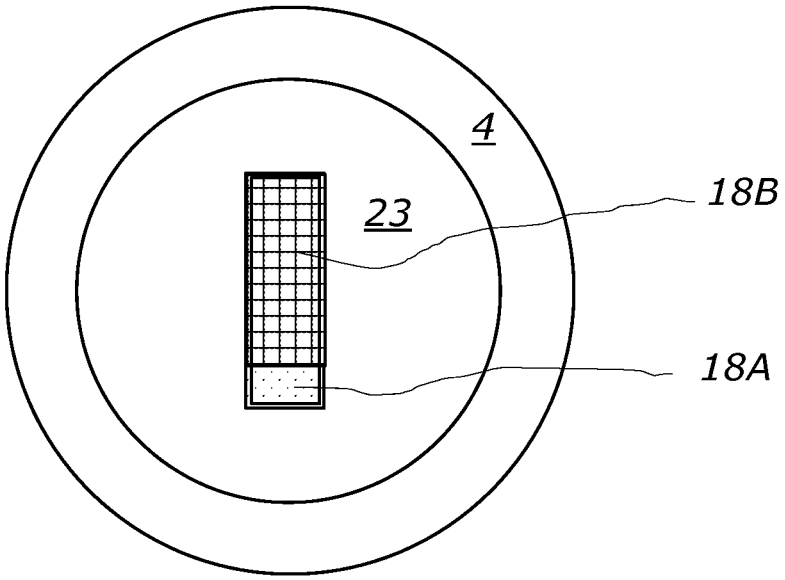
FIG. 8 is an end view of an earphone according to a second embodiment of the invention.

FIG. 8 is an end view of an earphone according to a second embodiment of the invention, where the first mesh part 18A and the second mesh part 18B are combined to a mesh device.

Figure 9:
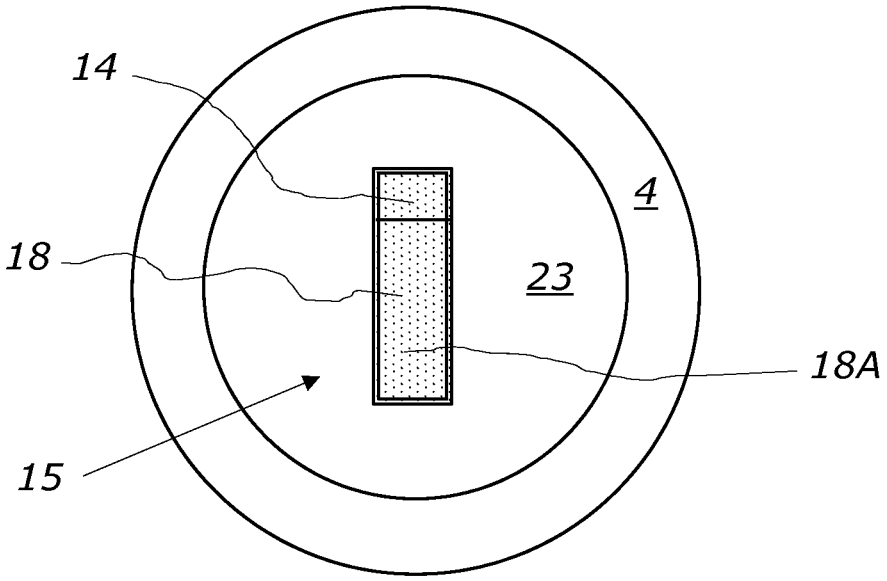
FIG. 9 is an end view of an earphone according to a third embodiment of the invention.

FIG. 9 is an end view of an earphone according to a third embodiment of the invention, where only a first mesh part 18A is used to provide a mesh device.

Figure 10:
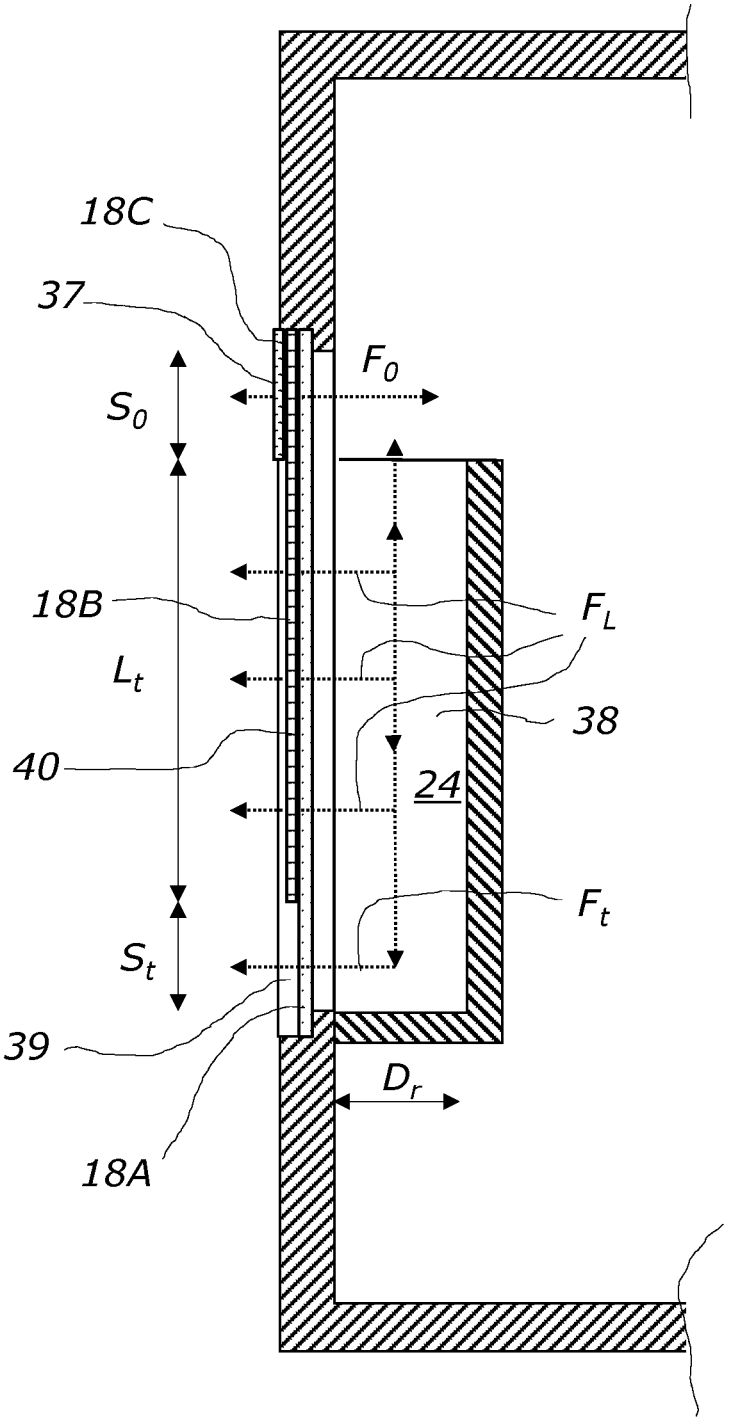
FIG. 10 is a cross-sectional view of the vent structure according to the first embodiment.

FIG. 10 is a cross-sectional view of the vent structure 18 according to the first embodiment. The vent structure 18 can be regarded as a combination of resistive opening 37, a port or tube 38 with a permeable tube wall 40. The depth of the recess cavity 24 provided by the recess 8 is $D_r$. The resistive opening 37 has an opening size $S_0$ and an acoustic resistivity as the sum of the resistivities of the first, second and third mesh parts 18A, 18B, 18C. The arrow $F_0$ represents airflow through the resistive opening 37. The tube 38 has a length $L_t$ and a tube opening 39 with the size of $S_t$. The acoustic resistance of the tube opening 39 is the resistance of the mesh part 18A. The arrow $F_t$ represents airflow through the tube opening 39. First and second mesh parts 18A and 18 provides the permeable tube wall part 40 with an acoustic resistance corresponding to the sum of the resistances of the first and second mesh parts 18A, 18B. The arrows $F_L$ represents airflow through the permeable tube wall part 40. The dimensions of the resistive opening 37, the tube 38 and the tube opening 39, and the resistance of the mesh parts can be chosen to tune the earphone to the desired acoustic properties. Thus, the tube can be tuned to have a resonance frequency between f. ex. 100 Hz and 1000 Hz.

Figure 11:
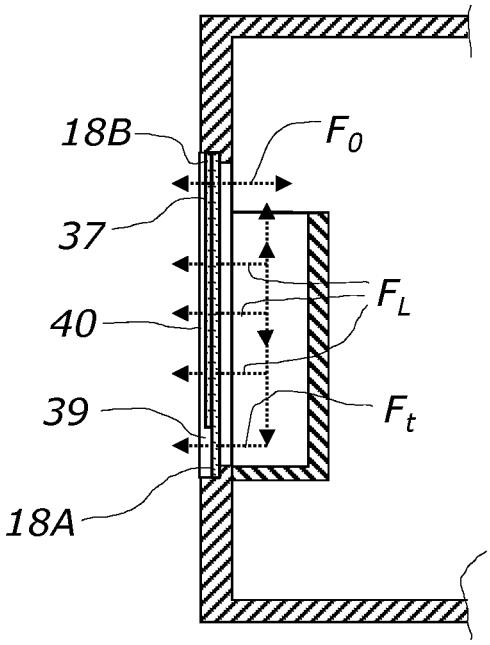
FIG. 11 is a cross-sectional view of the vent structure according to the second embodiment.

FIG. 11 is a cross-sectional view of the vent structure according to the second embodiment. This embodiment differs from the first embodiment by the third mesh part 18C is left out. Thus, the acoustic resistance of the resistive port 37 is only provided by the first and second mesh parts 18A, 18B.

Figure 12:
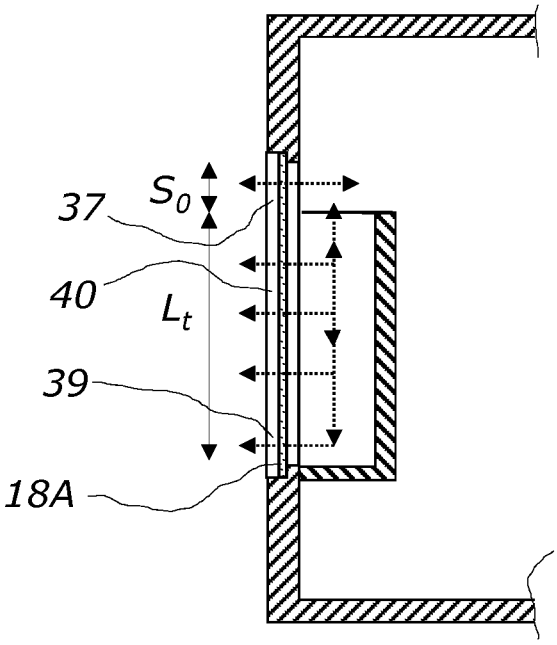
FIG. 12 is a cross-sectional view of the vent structure according to the third embodiment.

FIG. 12 is a cross-sectional view of the vent structure according to the third embodiment. Here, the resistance of the resistive port 37, the tube port and the permeable tube wall part 40 is only provided by the first mesh part 18A.

Figure 13:
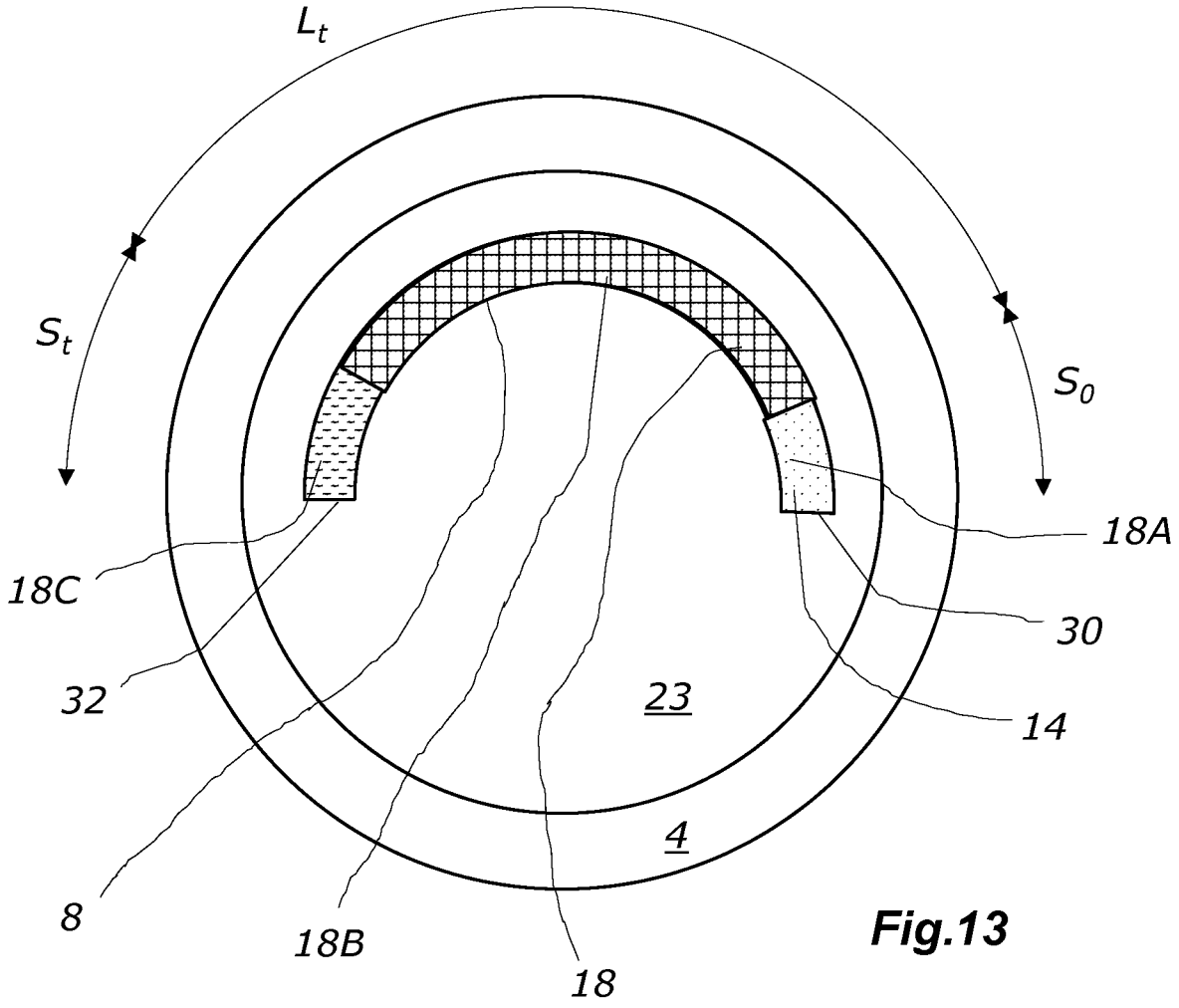
FIG. 13 is an end view of a fourth embodiment of the invention.

FIG. 13 is an end view of a fourth embodiment of the invention. Here the recess 8 is shaped as a half-circle. In this way a relative long tube can be obtained. The mesh device 18 is layered in the same way as the mesh device of the first embodiment.

The mesh device 18 can be premanufactured with by layering different mesh parts in any combination, which mesh device 18 in a simple step can be attached on the shoulder 31 along the edge of the recess 8 by f. ex. gluing or welding.

The invention can be utilised with circumaural earphones, which encompass the ears supra-aural earphones, which press against the ears and in-ear earphones.

The invention can be utilised with and without active noise cancellation.

REFERENCE SIGNS

1 earphone
2 head of wearer
3 ear
4 ear cushion
5 front chamber
6 ambient space
7 sound holes
8 recess
9 housing wall
10 rear chamber
11 diaphragm
12 bottom wall
13 recess wall
14 recess opening
15 vent structure
16 headband
17 headset
18 mesh device
19 microphone arm
20 microphone
21 cable
22 speaker
23 end wall
24 recess cavity
25 cross section of recess cavity
26 side wall
27 dividing wall
28 welding
29 earphone element
30 first end of recess
31 shoulder
32 second end of recess
33 core part
34 cavity part
35 injection mold
36 draw direction
37 resistive opening
38 tube
39 tube opening
40 permeable tube wall part

The invention claimed is:

1. An earphone configured to provide an acoustic output to an ear of a wearer and further configured to be arranged on the wearer's head in an operating position such that a front chamber between the head and the earphone is separated from ambient space, the earphone comprising:

a housing having a housing wall separating a rear chamber from ambient space, the housing wall including a dividing wall separating the rear chamber from the front chamber, a diaphragm suspended across an opening in the dividing wall and configured to be actively driven to provide the acoustic output, a vent structure fluidly connecting the rear chamber and ambient space through the housing wall, wherein the vent structure comprising a longitudinal recess in the housing wall, which recess is defined by a bottom wall and recess walls connecting the bottom wall and the housing wall, a recess opening in the recess, which recess opening connects the recess and the rear chamber, a mesh device arranged parallel with the bottom wall, whereby a longitudinal recess cavity is provided between the bottom wall and the mesh structure, wherein the earphone comprises a unitary earphone element comprising an end wall and a side wall, and wherein the recess is provided in the end wall, and wherein the earphone element is shaped, such it can be manufactured in an injection mould without overhangs.

2. An earphone according to claim 1, wherein the recess cavity has a length ($L_r$) of 5-30 mm.

3. An earphone according to claim 1, wherein the recess cavity has a width ($W_r$) of 1-10 mm.

4. An earphone according to claim 1, wherein the recess cavity has a depth ($D_r$) of 1-10 mm.

5. An earphone according to claim 1, wherein the recess cavity has a cross-section of 2-20 $mm^2$.

6. An earphone device according to claim 1, wherein the recess is curved.

7. A earphone according to claim 1, wherein the recess cavity is tuned to provide a resonance frequency in one of the ranges: 50-1000 Hz, 100-500 Hz, 150-400 HZ, 200-300 Hz.

8. An earphone according to claim 1, wherein the side wall is circumferential.

9. A method of manufacturing an earphone according to claim 1, wherein the earphone element is manufactured in an injection molding process, where after the mesh device is attached to the earphone element.

10. A method of manufacturing an earphone according to claim 1, wherein the dividing wall is attached to the circumferential side wall after the injection molding of the earphone element.

* * * * *